US005954483A

United States Patent [19]

Tetzlaff

[11] Patent Number: 5,954,483

[45] Date of Patent: Sep. 21, 1999

[54] GUIDE MEMBER DETAILS FOR A THROUGH-TUBING RETRIEVABLE WELL PUMP

[75] Inventor: Steven K. Tetzlaff, Huntington Beach, Calif.

[73] Assignee: Baker Hughes Incorporated, Houston, Tex.

[21] Appl. No.: 08/927,253

[22] Filed: Sep. 11, 1997

Related U.S. Application Data

[63] Continuation-in-part of application No. 08/753,158, Nov. 21, 1996.

[51] Int. Cl.[6] ..... F04B 17/03

[52] U.S. Cl. ..... 417/360; 166/242.6; 166/242.7; 166/105

[58] Field of Search ..... 417/360; 166/105, 166/242.6, 242.7

[56] References Cited

U.S. PATENT DOCUMENTS

| | | | |
|---|---|---|---|
| 3,677,665 | 7/1972 | Corkill | 417/410.1 |
| 4,592,427 | 6/1986 | Morgan . | |
| 4,678,031 | 7/1987 | Blandford et al. | 166/242.7 |
| 5,145,007 | 9/1992 | Dinkins . | |
| 5,501,580 | 3/1996 | Barrus et al. | 417/360 |
| 5,736,582 | 4/1998 | Patterson | 417/360 |
| 5,871,051 | 2/1999 | Mann | 417/360 |

*Primary Examiner*—Timothy S. Thorpe
*Assistant Examiner*—Cheryl J Tyler
*Attorney, Agent, or Firm*—James E. Bradley

[57] ABSTRACT

A well pump assembly has an electric motor that is secured to a lower end of a string of production tubing. The motor is powered by a power cable that extends alongside the tubing to the surface. The motor has an upper end with a drive shaft coupling. The pump for the motor is lowered through the production tubing on a wireline, wire rope or coiled tubing. The pump has a lower end which has a driven shaft coupling that makes up in stabbing engagement with the drive shaft coupling when the pump reaches the motor. The driven shaft coupling includes a guide which slides into a coupling housing. Orientating keys orient the guide and lock it from rotation.

8 Claims, 3 Drawing Sheets

GUIDE MEMBER DETAILS FOR A THROUGH-TUBING RETRIEVABLE WELL PUMP

CROSS-REFERENCED RELATED APPLICATIONS

This application is a Continuation-In-Part of application Ser. No. 08/753,158, filed Nov. 21, 1996, Wireline/Coiled Tubing Retrievable Well Pump.

TECHNICAL FIELD

This invention relates in general to well pumps, and in particular to a well pump which is operated by a submersible electric motor and is retrievable through tubing.

BACKGROUND ART

Electrical submersible well pumps for deep wells are normally installed within casing on a string of tubing. Usually the tubing is made up of sections of pipe screwed together. Coil tubing deployed from a reel is also used to a lesser extent. The motor is supplied with power through a power cable that is strapped alongside the tubing. The pump is typically located above the motor, is connected to the lower end of the tubing, and pumps fluid through the tubing to the surface. One type of a pump is a centrifugal pump using a large number of stages, each stage having an impeller and a diffuser. Another type of pump, for lesser volumes, is a progressive cavity pump. This pump utilizes a helical rotor that is rotated inside an elastomeric stator which has double helical cavities. The stator is located inside a metal housing.

Periodically, the pump assembly must be pulled to the surface for repair or replacement. This involves pulling the tubing, which is time consuming. A workover rig is necessary for production tubing, and a coiled tubing unit is needed to pull coiled tubing. Often, the electrical motor needs no service, rather the service needs to be performed only on the pump. Sometimes the only change needed is to change the size of the pump without changing the size of the motor. However, the motor, being attached to the lower end of the pump, is also pulled along with the tubing. Damage to the power cable is not uncommon when pulling the tubing.

SUMMARY OF INVENTION

In this invention, the motor is secured to the lower end of the tubing. The power cable to the motor is strapped alongside the tubing. The pump, however, is sized to be lowered through the tubing. The pump has a driven shaft extending downward from it that mates with a drive shaft extending upward from the motor. When the pump reaches the motor, the driven shaft will stab into the drive shaft.

A head assembly is located at the upper end of the pump for engagement by a running tool to lower the pump through the tubing and retrieve it. The head may be secured to wireline, wire rope or coiled tubing which inserts through the production tubing. The head lands within a sub in the production tubing to latch the pump in place. The pump pumps well fluid up through the tubing.

When it is desirable to change out or repair the pump, the operator lowers a running tool through the production tubing and latches it to the head. The operator pulls the pump, leaving the motor in place. Subsequently, the running tool lowers the repaired or replacement pump back through the tubing into engagement with the motor.

The electric motor assembly is mounted to a coupling housing which is secured to the lower end of the tubing. The coupling housing has an anti-rotation key within its bore. The drive shaft of the electric motor assembly extends into the coupling housing.

The lower end of the pump assembly driven shaft is located within a tubular guide. The guide extends slidingly into the coupling housing as the pump assembly is being lowered. The guide rotatably receives the lower portion of the drive shaft. The guide has an engagement member on its exterior which engages the internal anti-rotation member in the bore of the coupling housing.

BEST MODE FOR CARRYING OUT THE INVENTION

Figure 1A:
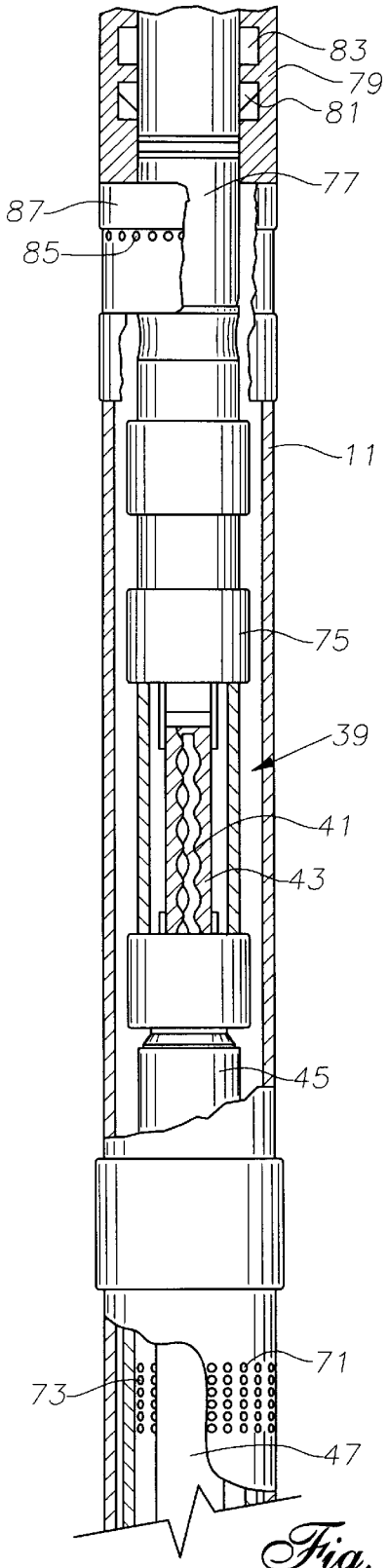
FIGS. 1A, 1B and 1C make up a partial sectional view of a pump system in accordance with this invention.
Figure 1B:
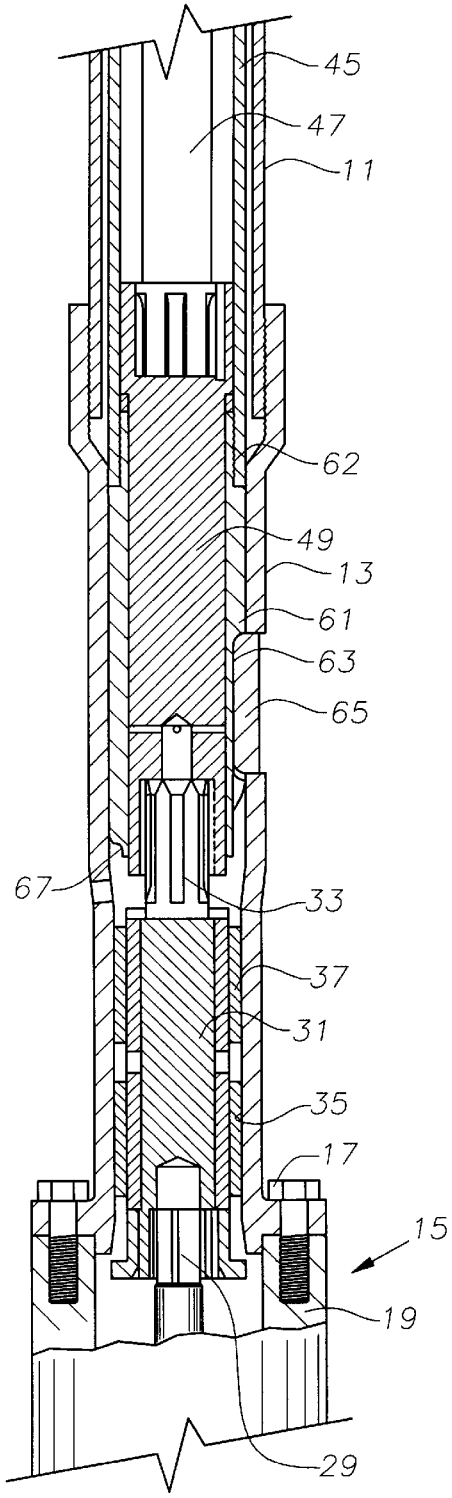
Figure 1C:
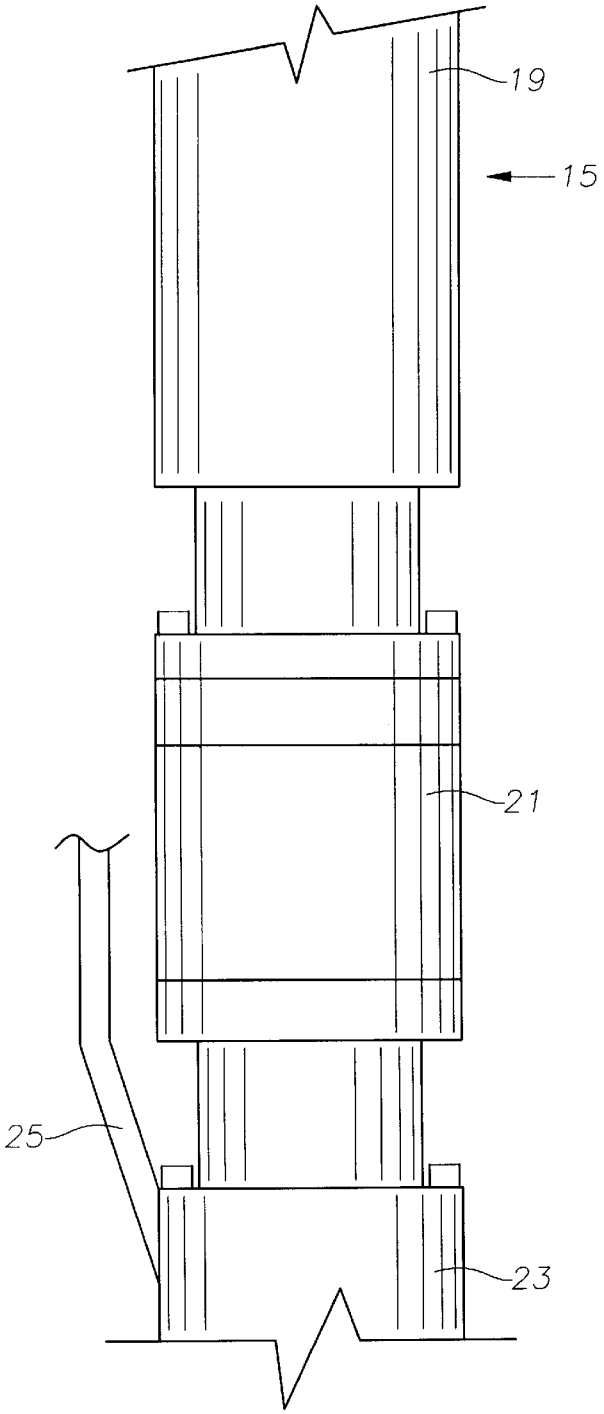

Referring to FIGS. 1A, 1B, and 1C, a string of production tubing 11 will extend from the surface into a cased well (not shown). Production tubing 11 is a conduit made up of sections of pipe, for example four inches in diameter, screwed together. A coupling housing 13 is located at and forms the lower end of tubing 11. Coupling housing 13 is a tubular member with approximately the same diameter as tubing 11 and is connected to tubing 11 by threads.

An electric motor assembly 15 is secured to coupling housing 13 by bolts 17. Motor assembly 15 includes a seal section 19 mounted to a gear reducer 21, which in turn is mounted to an A.C. electric motor 23 (FIG. 1C). A three-phase power cable 25 connects to motor 23 and extends alongside tubing 11 to the surface for delivering power. Motor 23 typically operates at about 2600 rpm which is reduced by gear reducer 21 to a lower speed. Seal section 19 seals well fluid from the interior of motor 23 and also equalizes pressure differential between lubricant in motor 23 and the exterior.

As shown in FIG. 1B, a drive shaft 27 extends upward from and is driven by motor 23. Drive shaft 27 has a splined end 29 which mates with a drive shaft coupling 31. Drive shaft coupling 31 is a short shaft which forms the upper end of drive shaft 27. Drive shaft coupling 31 has a splined upper end 33 and is carried within bore 35 of coupling housing 13. Drive shaft coupling 31 is rotatably supported within bore 35 by bushings 37.

Referring again to FIG. 1A, a progressing cavity pump 39 is driven by motor 23. Progressing cavity pump 39 is conventional, having a metal rotor 41 which has an exterior helical configuration. Rotor 41 orbitally rotates within an elastomeric stator 43. Stator 43 has double helical cavities located along its axis through which rotor 41 rotates. A tubular housing 45 is secured to a lower end of pump 39 and may be considered a part of pump 39. A metal flexible shaft 47 is located within housing 45. Flexible shaft 47 orbits at its upper end and rotates in pure rotation at its lower end.

Flexible shaft 47 is connected on its upper end to rotor 41 and may be considered a part of a driven shaft of pump 39.

Figure 3:
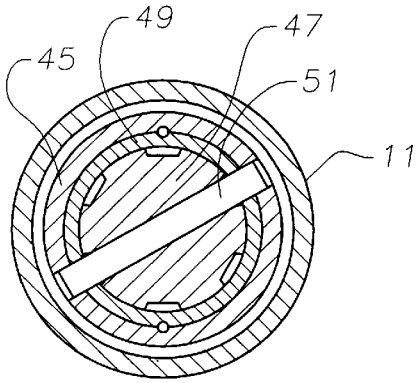
FIG. 3 is a sectional view of a portion of the pump assembly of FIG. 2, taken along the line 3—3 of FIG. 2.
Figure 4:
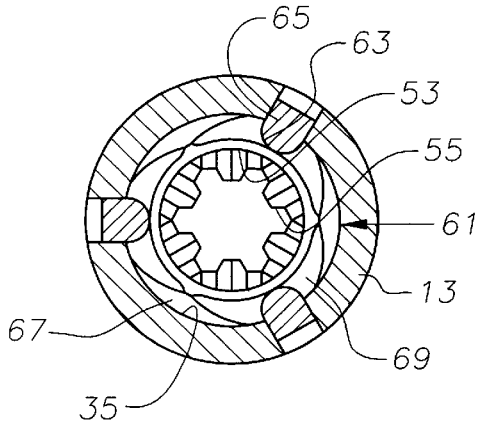
FIG. 4 is a sectional view of a portion of the pump assembly of FIG. 2, taken along the line 4—4 of FIG. 2.

Referring again to FIG. 1B, flexible shaft 47 has a driven shaft coupling 49 on its lower end. Driven shaft coupling 49 is secured to flexible shaft 47 by a pin 51 as shown in FIG. 3. Flexible shaft coupling 49 is a solid cylindrical member which has a cavity on its lower end containing a receptacle 53 having splines 55 as shown in FIG. 4. Receptacle 53 has an upward extending shank 57 to secure receptacle 53 within the cavity of drive shaft coupling 49 by means of a pin 51. Receptacle 53 mates slidingly with splined upper end 33 of drive shaft coupling 31.

Figure 5:
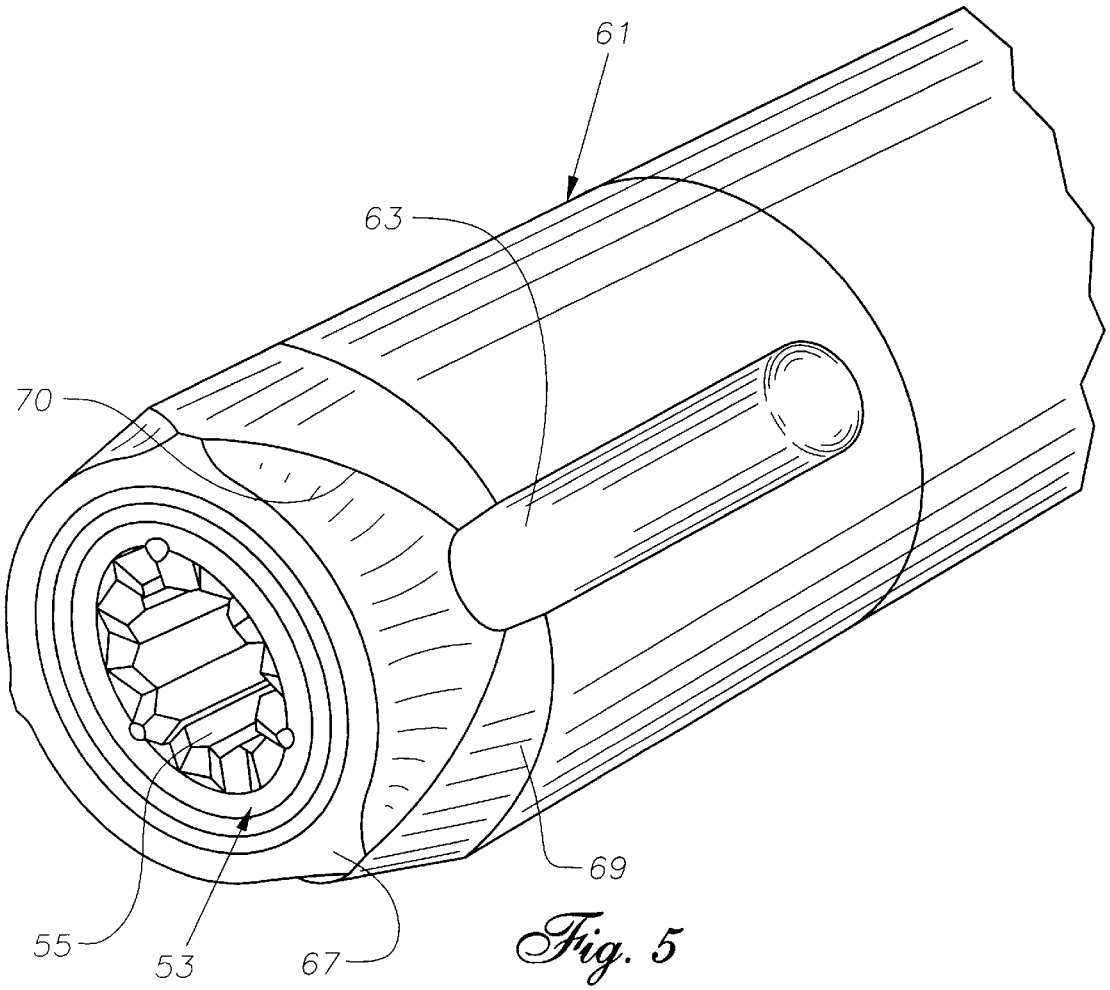
FIG. 5 is a partial, detailed view of the guide member illustrating the tapered surfaces on the nose section and the splined receptacle.

A guide 61 surrounds driven shaft coupling 49. Guide 61 is a tubular member or sleeve having an outer diameter for close reception within bore 35 of coupling housing 13. Guide 61 has a bore through it which rotatably receives driven shaft coupling 49. Guide 61 has threads 62 on its upper end which secure to flexible shaft housing 45. Guide 61 also has three elongated slots 63 on its exterior spaced 120° apart as shown in FIGS. 1B, 4 and 5. Slots 63 are sized to mate with three keys 65. Keys 65 are mounted to coupling housing 13 and protrude radially inward into bore 35. Keys 65 are also 120° apart from each other and serve to prevent rotation of guide 61 in coupling housing 13.

Guide 61 has a tapered nose 67 for orienting and mating slots 63 with keys 65 when pump 39 is lowered into engagement with motor assembly 15. As shown in FIG. 5, preferably there are three tapered surfaces 69 on nose 67. Each tapered surface 69 extends upward and leads to one of the slots 63. Each tapered surface 69 has two cam edges 70 on its sides. Cam edges 70 converge toward each other from the extreme lower end of nose 67 to one of the slots 63. During stabbing engagement, one of the cam edges 70 of each tapered surface 69 will engage one the keys 65, which causes guide 61 to rotate and align slots 63 with keys 65.

Referring again to FIG. 1A, well fluid for pump 39 is drawn through perforations 71 in tubing 11 below pump 39 and through perforations 73 in flexible shaft housing 45. A head assembly is mounted to the upper end of pump 39. The head assembly includes spacing nipples 75, which are cylindrical sections of pipe through which well fluid will be discharged by pump 39. The head assembly also includes a head 77 mounted above spacing nipples 75. Head 77 is a tubular member having a passage through it for the passage of well fluid being discharged from the upper end of pump 39. Head 77 has an upper end that is adapted to be secured to a running tool (not shown), which is deployed either by wireline, wire rope, or coiled tubing.

Head 77 lands within a latch sub 79 which is connected into the string of tubing 11. Seals located on head 77 seal the interior of latch sub 79. Latch sub 79 has an interior profile that cooperates with load bearing and locking members to land and retain pump 39 in place. Head 77 has a latch 81 which selectively engages head 77 to latch sub 79 to prevent upward movement of pump 39. Head 77 also has a set of slips 83 which engage the profile of latch sub 79 to support the weight of pump 39 as well as downthrust from pump 39. Head 77, latch sub 79, latch 81 and slips 83 are shown schematically and are commercially available.

Latch sub 79 also has a plurality of equalizing ports 85. A closure sleeve 87 is movable axially on sub 79 by a running tool to selectively open and close equalizing ports 85. When open, and when head 77 is retrieved, equalizing ports 85 allow fluid in tubing 11 to flow downward out equalizing ports 85 until reaching equilibrium with fluid in the casing. If it is necessary to pull tubing 11, this feature allows the fluid within tubing 11 to drain.

In operation, during initial installation, the operator will connect the motor assembly together including gear reducer 21 and seal section 19. The operator connects the motor assembly to coupling housing 13, and connects coupling housing 13 to the lower end of a string of tubing 11. The operator connects latch sub 79 into tubing 11 above coupling housing 13 at a distance substantially equal to the length of the pump assembly. The operator then lowers the string of tubing 11 into the well to its desired depth. Power cable 25 is strapped alongside tubing 11 as tubing 11 is lowered into the well.

Figure 2:
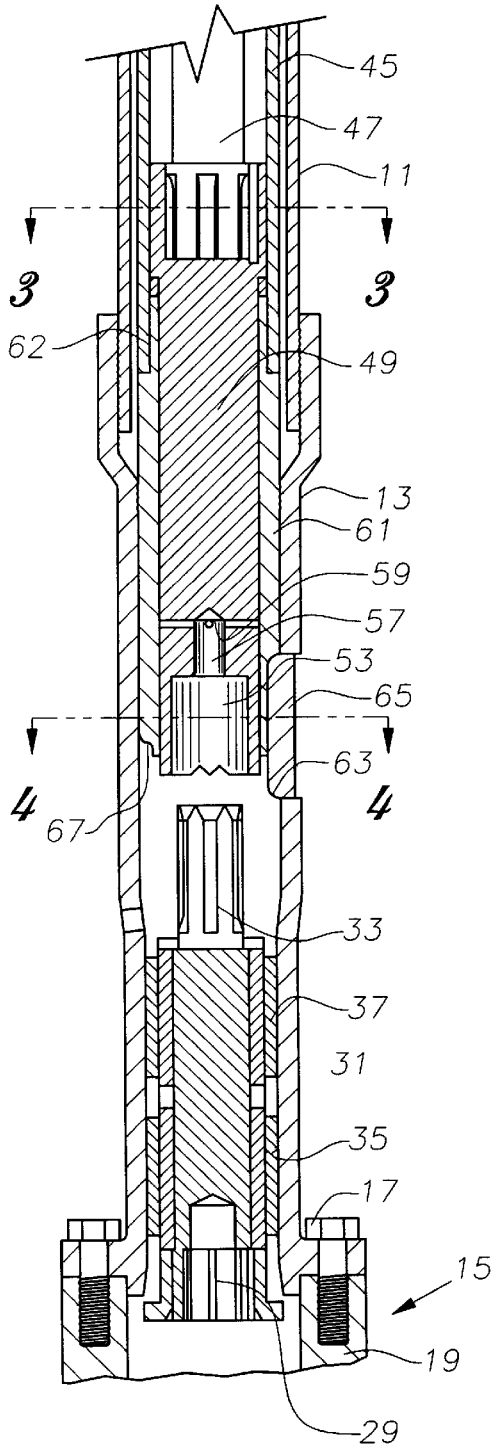
FIG. 2 is a sectional view similar to FIG. 1B, but showing the lower end of the pump assembly being lowered into engagement with the upper end of the electrical motor assembly.

The operator then makes up the pump assembly including pump 39, flexible shaft housing 45, spacing nipples 75 and head 77. The operator latches head 77 to a running tool (not shown). The running tool is fastened to a line, which may be wireline, wire rope or coiled tubing. The operator lowers the pump assembly through tubing 11. FIG. 2 shows guide 61 shortly before it stabs into engagement with drive shaft coupling 31. Tapered surfaces 69 on guide 61 will contact keys 65 and rotate guide 61 an amount necessary to orient slots 63 with keys 65. Receptacle 53 will slide over splined upper end 33, engaging pump 39 with motor 23. Latch 81 and slips 83 (FIG. 1A) will be actuated to support the weight of pump 39 and also prevent it from being pushed upward.

The operator supplies power to power cable 25, which causes motor 23 to rotate, which in turn rotates flexible shaft 47 and rotor 41. Well fluid is drawn in through intake ports 71, 73. The well fluid pumps out the upper end of pump 39 and through head 77. The well fluid flows upward through production tubing 11 to the surface.

When it is desired to change out pump 39 for repairs or otherwise, the operator lowers the running tool on a line back into engagement with head 77. The running tool releases latch 81 and pulls upward on head 77. Pump 39 will move upward, bringing along with it flexible shaft 47 and guide 61 as illustrated in FIG. 2. Motor 23 will remain in place as the operator pulls the pump assembly to the surface. The operator replaces or repairs the pump assembly and reinstalls it in the same manner as described.

The invention has significant advantages. By leaving the motor in place and retrieving only the pump, the operation to change out the pump is much faster. In the case of production tubing, a workover rig need not be employed for pulling the tubing. Damage to the power cable is avoided as the production tubing will remain in place. Reducing the expense of changing out the pump reduces the cost of using a pump of this nature in the well. The guide readily orients and stabs the lower end of the pump into engagement with the drive shaft coupling.

While the invention has been shown in only one of its forms, it should be apparent to those skilled in the art that it is not so limited but is susceptible to various changes without departing from the scope of the invention.

I claim:

1. An apparatus adapted to be suspended on a conduit in a well for pumping fluid, comprising:

a coupling housing adapted to be secured to a lower end of a conduit, the coupling housing having an inner cylindrical wall;

an electric motor assembly secured to the coupling housing, the electric motor assembly having a drive shaft which has a drive shaft coupling on an upper end and which is positioned in the coupling housing;

a pump assembly having a driven shaft which has a driven shaft coupling on a lower end which extends into the coupling housing and slidingly mates with the drive shaft coupling;

a head on an upper end of the pump assembly which allows the pump assembly to be lowered into and retrieved from the conduit while the electric motor assembly remains stationarily supported by the coupling housing;

an internal anti-rotation member mounted to the inner wall in the coupling housing; and a guide which rotatably receives a lower portion of the driven shaft, the guide being a tubular member having an outer diameter sized for close reception within the inner wall of the coupling housing;

a slot on the outer diameter of the guide which slides into engagement with the anti-rotation member while the driven shaft coupling is lowered into engagement with the drive shaft coupling; and an annular nose on a lower end of the guide which has a tapered portion for engaging the anti-rotation member and orienting the engagement member with the anti-rotation member.

2. The apparatus according to claim 1, wherein the driven shaft coupling is located above the nose.

3. The apparatus according to claim 1, wherein the driven shaft coupling is recessed within the guide.

4. The apparatus according to claim 1, wherein the tapered portion of the nose has two cam edges which converge toward each other from a lower extremity of the nose to the slot to rotationally orient the slot with the anti-rotation member as the pump is lowered into engagement with the motor.

5. An apparatus for pumping fluid through a conduit in a well, comprising:

a coupling housing adapted to be secured to a lower end of a conduit, the coupling housing having a bore;

an electric motor assembly secured to and supported by the coupling housing, the electric motor assembly having a drive shaft which has a drive shaft coupling on an upper end and which is positioned in the bore of the coupling housing;

a pump assembly having a driven shaft with a driven shaft coupling on a lower end which mates with the drive shaft coupling and a head on an upper end which allows the pump assembly to be lowered through and retrieved from the conduit while the motor remains stationarily secured to the coupling housing;

a tubular guide on a lower end of the pump assembly which extends into the coupling housing and which rotatably receives a lower portion of the driven shaft;

at least one internal anti-rotation key in the bore of the coupling housing;

at least one engagement slot on an exterior of the guide which slides into engagement with the anti-rotation slot while the pump assembly is lowered into engagement with the electric motor assembly; and a tapered section on a lower end of the guide, the tapered section having at least one cam edge which extends partially circumferentially between the lower end of the guide and the slot for contacting the key to rotationally orient the slot with the key while lowering the pump into engagement with the motor.

6. The apparatus according to claim 5, wherein said at least one key comprises a plurality of keys spaced circumferentially around the bore, and said at least one slot comprises a plurality of slots spaced around the guide.

7. The apparatus according to claim 5, wherein the driven shaft coupling is recessed within the guide.

8. An apparatus adapted to be suspended on a conduit in a well for pumping fluid, comprising:

a coupling housing adapted to be secured to a lower end of a conduit, the coupling housing having a bore;

a plurality of keys located in the bore and spaced circumferentially from each other;

an electric motor assembly secured to the coupling housing, the electric motor assembly having a drive shaft which has a drive shaft coupling with a splined upper end which is positioned in the coupling housing;

a pump assembly having a driven shaft which has a driven shaft coupling with a splined lower end which extends into the coupling housing and slidingly mates with the drive shaft coupling;

a tubular guide on a lower end of the pump assembly which has an outer diameter sized to closely slide into the bore of the coupling housing and which rotatably receives a lower portion of the driven shaft and the driven shaft coupling;

a plurality of slots formed in the outer diameter of the guide which mate with the keys in the bore;

a separate tapered section on a lower end of the guide for each of the keys, each of the tapered sections having a pair of cam edges which converge from a lower end of the guide toward one of the slots for engaging one of the keys to rotate the guide and orient the slots with the keys; and a head on an upper end of the pump assembly which allows the pump assembly to be lowered into and retrieved from the conduit while the electric motor assembly remains stationarily supported by the coupling housing.

* * * * *